US007503411B2

(12) United States Patent
Radke et al.

(10) Patent No.: US 7,503,411 B2
(45) Date of Patent: Mar. 17, 2009

(54) ARTICULATED DOZER WITH FRAME STRUCTURE FOR DECREASED HEIGHT VARIATION IN THE VEHICLE CHASSIS

(75) Inventors: Daniel Dean Radke, Dubuque, IA (US); James Arthur Nagorcka, Tarrington Victoria (AU); Lyal Douglas Allen, Hamilton Victoria (AU); Lawrence William Bergquist, Dubuque, IA (US)

(73) Assignee: Deere & Company, Moline, IL (US)

( * ) Notice: Subject to any disclaimer, the term of this patent is extended or adjusted under 35 U.S.C. 154(b) by 492 days.

(21) Appl. No.: 11/286,727

(22) Filed: Nov. 23, 2005

(65) Prior Publication Data

US 2006/0113749 A1 Jun. 1, 2006

Related U.S. Application Data

(60) Provisional application No. 60/631,541, filed on Nov. 29, 2004.

(51) Int. Cl.
*B60G 17/00* (2006.01)
*B62D 55/065* (2006.01)

(52) U.S. Cl. ..... 180/9.46; 180/9.5; 280/781

(58) Field of Classification Search ..... 180/9.42, 180/9.5, 9.54, 9.56, 9.58, 9.6, 9.1, 311, 312, 180/9.44, 9.46, 418, 419; 280/781, 790, 280/792

See application file for complete search history.

(56) References Cited

U.S. PATENT DOCUMENTS

| | | | | |
|---|---|---|---|---|
| 2,673,616 | A * | 3/1954 | Moores | 180/237 |
| 3,435,908 | A * | 4/1969 | Sunderlin et al. | 180/9.44 |
| 3,763,938 | A | 10/1973 | Brodersen | 172/789 |
| 3,899,028 | A | 8/1975 | Morris et al. | 172/4.5 |
| 3,907,041 | A | 9/1975 | Manor | 172/780 |
| 3,974,699 | A | 8/1976 | Morris et al. | 73/432 |
| 3,986,563 | A | 10/1976 | Stubben | 172/793 |
| 4,053,017 | A | 10/1977 | Gill et al. | 172/4.5 |
| 4,061,194 | A | 12/1977 | McCanse | 172/447 |
| 4,088,236 | A | 5/1978 | Moore | 214/90 |
| 4,124,080 | A | 11/1978 | McCanse | 172/447 |
| 4,213,507 | A | 7/1980 | Horrer et al. | 172/784 |
| 4,340,126 | A | 7/1982 | Larson | 180/305 |
| 4,635,730 | A | 1/1987 | Larsson | 172/788 |
| 4,696,350 | A | 9/1987 | Ruhter et al. | 172/793 |
| 4,807,461 | A | 2/1989 | Brimeyer et al. | 172/793 |
| 5,074,061 | A | 12/1991 | Thompson | 37/129 |
| 5,533,587 | A * | 7/1996 | Dow et al. | 180/235 |
| 5,549,412 | A | 8/1996 | Malone | 404/84.1 |

(Continued)

*Primary Examiner*—Anne Marie Boehler

(57) ABSTRACT

An articulated loader has an articulated chassis and two A-frames. The points of the A-frames face each other. The articulated chassis includes a front portion and a rear portion. Likewise, there is a front or first A-frame and a rear or second A-frame. The A-frames are connected to the overall chassis at points close to but offset from the point of vehicle articulation via ball joints and via hydraulic suspension cylinders toward the wider portions of the "A"s. The vehicle is propelled along the ground by tracks that are independently suspended. The A-frames are of approximate equal length along the axis of the vehicle and the ball joints are located as close as practical to the articulation joint. Thus, any vertical forces at the ball joints due to variations in tractive efforts for the vehicle tend to be equal and opposite in direction and to, therefore, minimize any chassis height variations.

5 Claims, 7 Drawing Sheets

U.S. PATENT DOCUMENTS

| | | | | |
|---|---|---|---|---|
| 5,632,350 | A * | 5/1997 | Gauvin | 180/9.44 |
| 5,762,446 | A | 6/1998 | Manatt et al. | 404/75 |
| 5,775,438 | A | 7/1998 | Confoey et al. | 172/831 |
| 5,921,706 | A | 7/1999 | Manatt et al. | 404/72 |
| 6,322,287 | B1 | 11/2001 | Yelton | 404/118 |
| 6,382,873 | B1 | 5/2002 | Mulders et al. | 404/128 |
| 6,691,795 | B2 | 2/2004 | L'Abbe | 172/787 |
| 2002/0162669 | A1 | 11/2002 | L'abbe | 172/787 |

* cited by examiner

ARTICULATED DOZER WITH FRAME STRUCTURE FOR DECREASED HEIGHT VARIATION IN THE VEHICLE CHASSIS

This document claims priority based on U.S. provisional; application Ser. No. 60/631,541, filed Nov. 29, 2004, and entitled ARTICULATED DOZER WITH FRAME STRUCTURE FOR DECREASED HEIGHT VARIATION IN THE VEHICLE CHASSIS, under 35 U.S.C. 119(e).

FIELD OF THE INVENTION

This applies to an articulated crawler dozer with 4 independent tracks and a suspension system. In this configuration, the track systems are mounted such that they can move in a way that they can follow the contour of the ground.

BACKGROUND OF THE INVENTION

Conventional construction machinery (dozers, loaders, backhoes, skid steers, graders, etc) do not usually have cushioning suspension systems beyond the pneumatic tires included with some of this equipment. Thus, the machine ride can be very harsh when the terrain on which the vehicle travels is rough or uneven.

It is generally recognized that harshness of ride in construction machinery may be reduced via the use of suspension systems but only at a cost of lowered operational accuracy and efficiency. One major concern with suspension systems is the undesired motions that can result because of the addition of the systems as compared to a rigid mounted system. Thus, more sophisticated suspension systems are avoided as these systems tend to introduce vehicular height variations during work operations, causing inaccuracies and reducing work efficiencies.

An example of the height variations noted above is the vertical motion observed when a Semi-tractor trailer combination accelerates from a stop light. The forces from acceleration on these vehicles can, and often do, result in a twisting of the vehicle. Another example is the squat observed in the rear axle of automobiles with certain independent rear axle suspension systems. Such movements could be detrimental to the ability of a grading machine to perform its required tasks; squatting and twisting motions can cause changes in the position of a work tool such as, for example, a blade relative to the ground. Thus, the addition of suspension to a conventional work machine such as a grader can create a situation that improves vehicle ride but counters the operational efficiency of the machine by rendering a softness in the vehicle support and degrading the accuracy of blade movements.

SUMMARY OF THE INVENTION

The invention includes a front A-frame and a rear A-frame as well as an articulated chassis having a front portion and a rear portion. The front and rear A-frames are pivotally attached to the front and rear portions of the articulated chassis, respectively, via ball joints. The point of attachment for the front A-frame is slightly forward of the chassis articulation joint and the point of attachment for the rear A-frame is slightly rearward of the chassis articulation joint. Relative lateral movement between the front and rear A-frames and the respective front and rear portions of the articulated chassis to which they are attached are constrained due to pan hard rod connections between each of the A-frames and the articulated chassis at each end of the articulated chassis. Toward each end of the chassis two suspension cylinders situated between the chassis and each A-frame support the articulated chassis above the A-frames allowing relative vertical movements between the A-frames and the chassis.

The A-frames are essentially of equal length while the ball joints for the A-frame connections are located along the centerline of the vehicle; and positioned as close together as practical. Such an arrangement results in vertical forces at the ball joint attachments to the chassis that are equal in magnitude and opposite in direction, tending to neutralize loads that would otherwise cause height variations in the chassis upon acceleration/deceleration of the vehicle. The close proximity of the two ball joints also results in minimal torque on the frame and, thus, decreased height variations.

BRIEF DESCRIPTION OF THE DRAWINGS

Embodiments of the invention will be described in detail, with references to the following figures, wherein.

DESCRIPTION OF THE ILLUSTRATED EMBODIMENT

The exemplary embodiment of the invention described herein is applied to a crawler dozer with 4 independent tracks. In this configuration, the tracks are mounted such that they can move in a way that they can follow the contour of the ground. Each of the tracks pivot independently.

Figure 1:
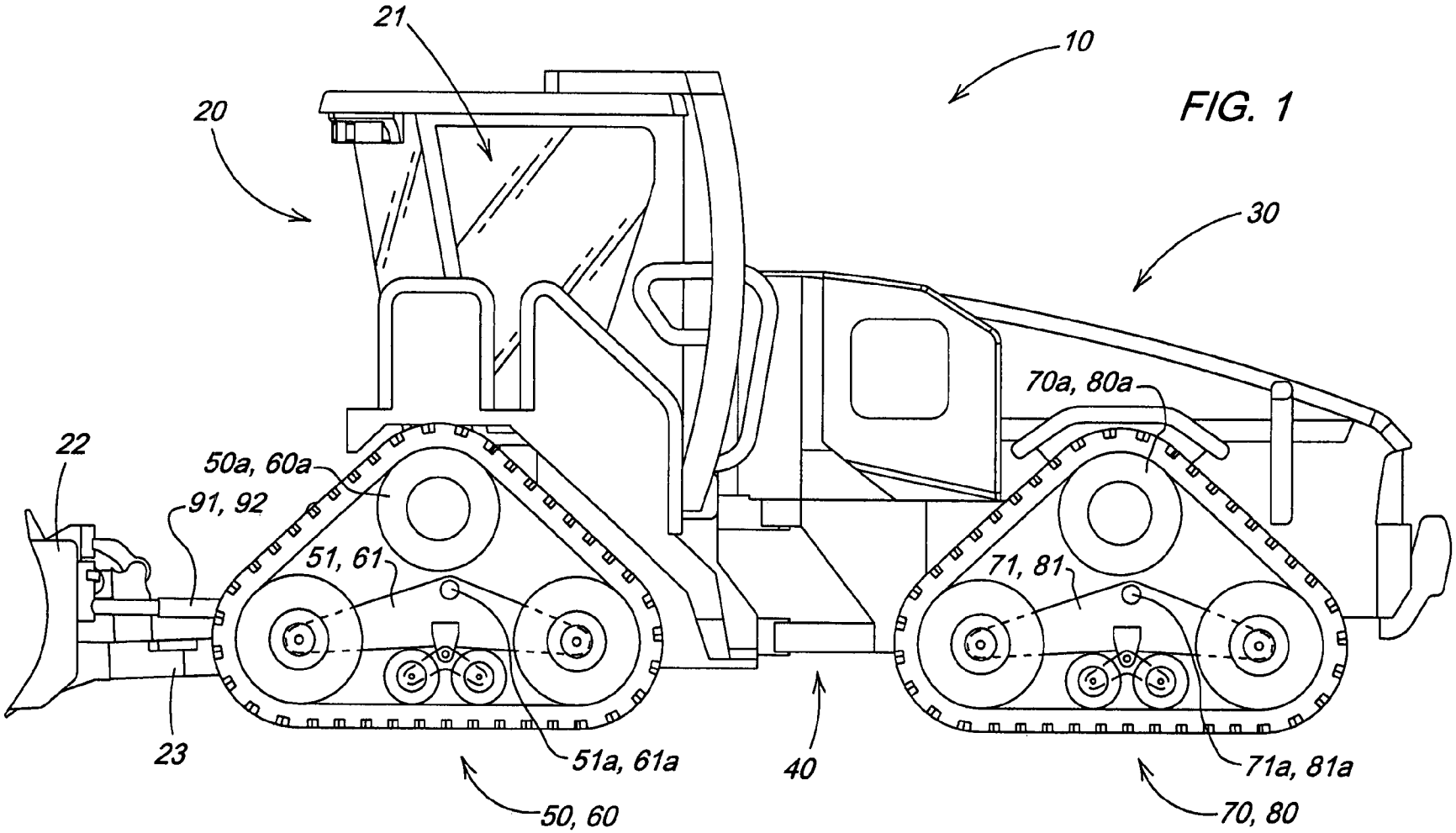
FIG. 1 is a side view of a work vehicle in which the invention may be used.

FIG. 1 illustrates a vehicle in which the invention may be used. The particular vehicle illustrated in FIG. 1 is a four track articulated dozer 10 having a front vehicle portion 20 a rear vehicle portion 30; an articulation mechanism 40 between the front vehicle portion 20 and the rear vehicle portion 30; first and second track systems 50, 60; and third and fourth track systems 70, 80. As indicated in FIG. 1, the first and second track systems 50, 60 are, respectively, located on the first and second sides of the front vehicle portion 20 and the third and fourth track systems 70, 80 are respectively located on the first and second sides of the rear vehicle portion 30. As in conventional track vehicles, the vehicle 10 is steered by adjusting the articulation angle between the front vehicle portion 20 and the rear vehicle portion. The front vehicle portion 20 includes a blade 22 and a blade mounting frame 23 as well as an operator cab 21.

Figure 2:
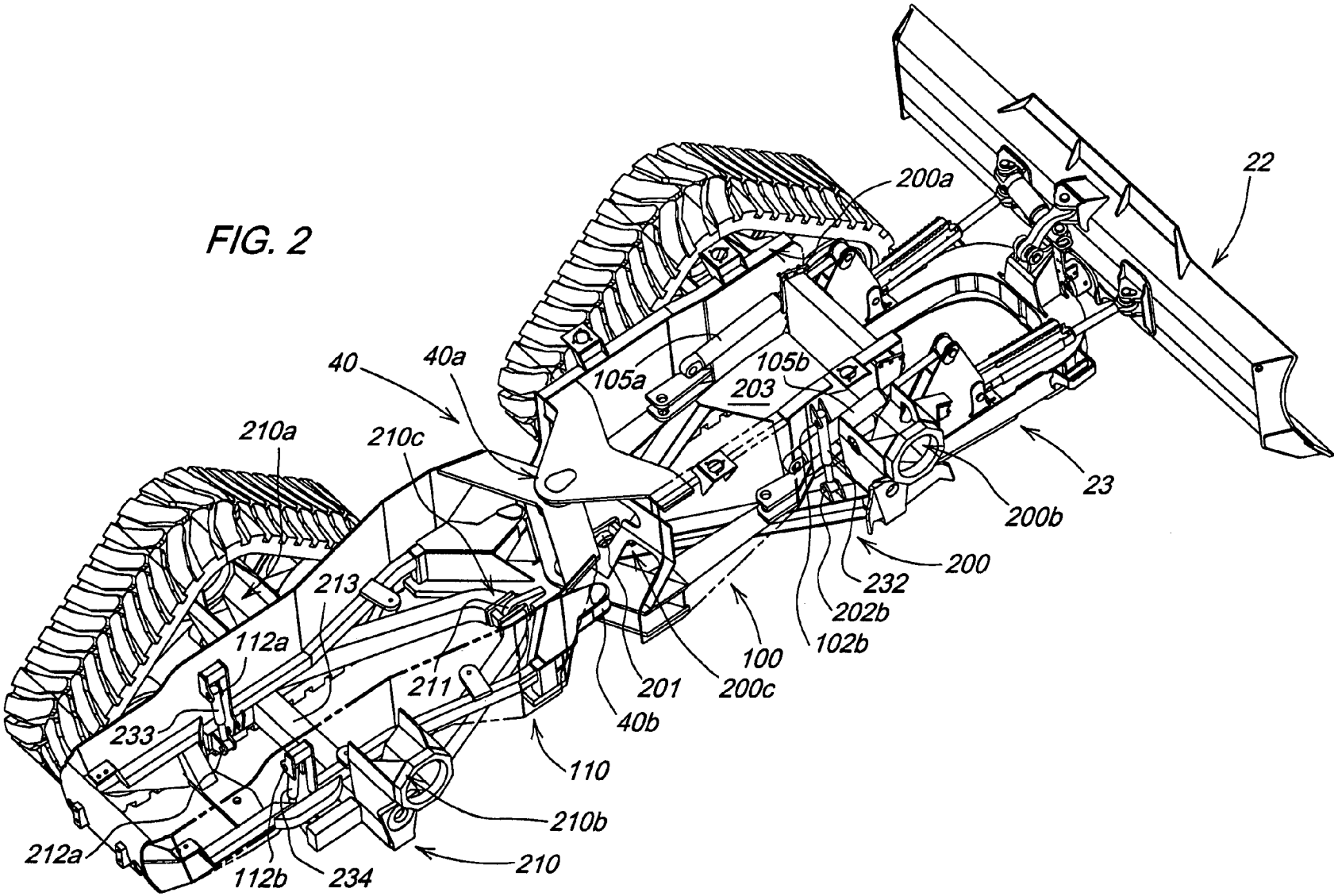
FIG. 2 is an elevated oblique view of an articulated chassis, two A-frames and a C-frame of the vehicle illustrated in FIG. 1 where two of the track assemblies are not shown.
Figure 3:
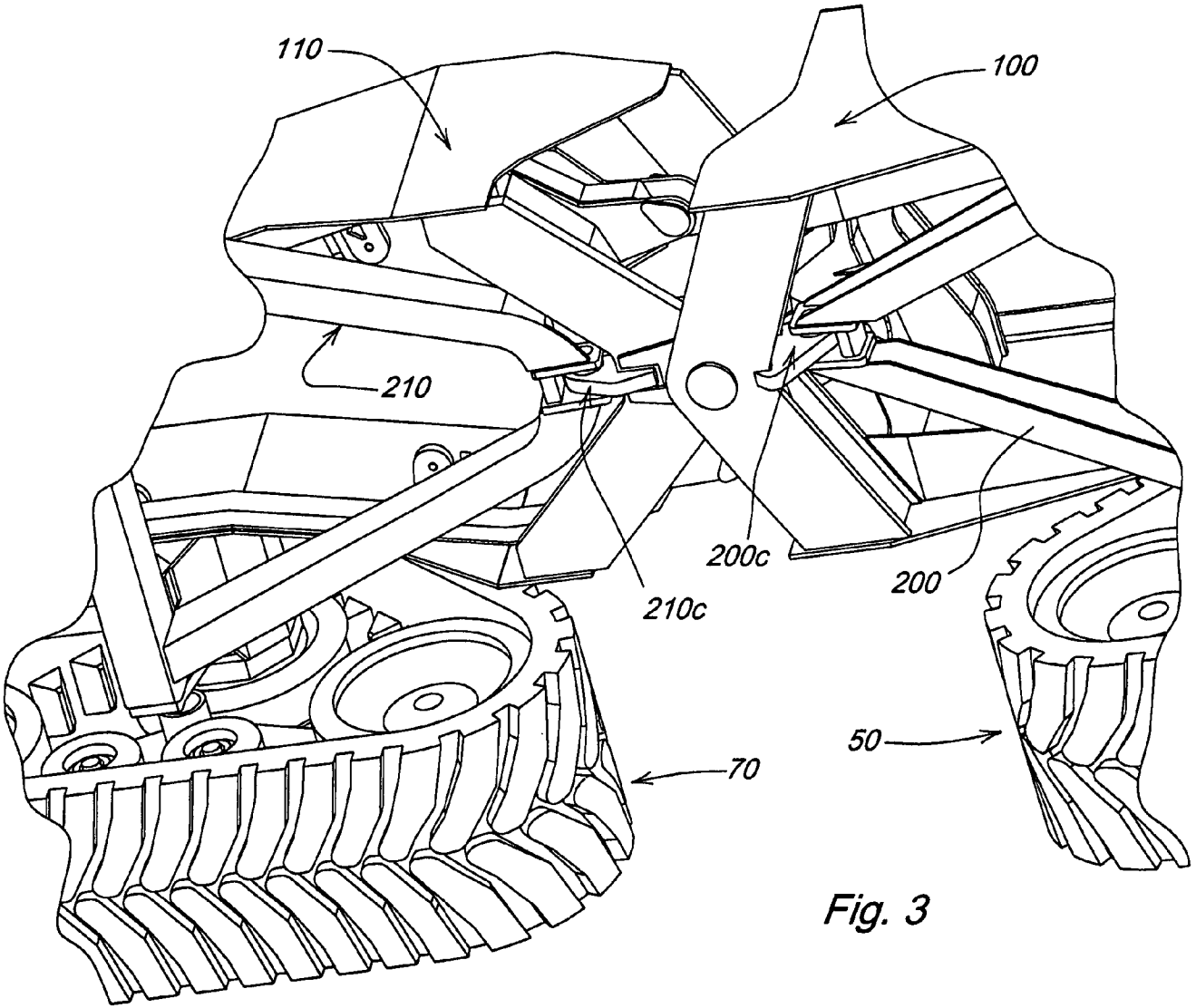
FIG. 3 is an oblique view of a portion of the underside of the articulated chassis, the two A-frames and two track frames shown in FIG. 2.
Figure 4:
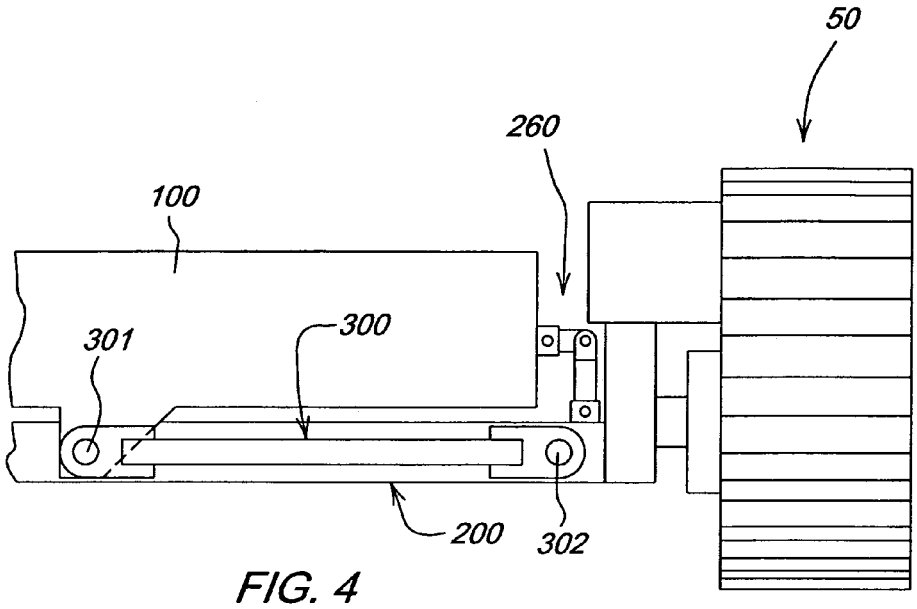
FIG. 4 is a front view of a front portion of the chassis and a first A-frame connected by a pan hard rod.
Figure 6:
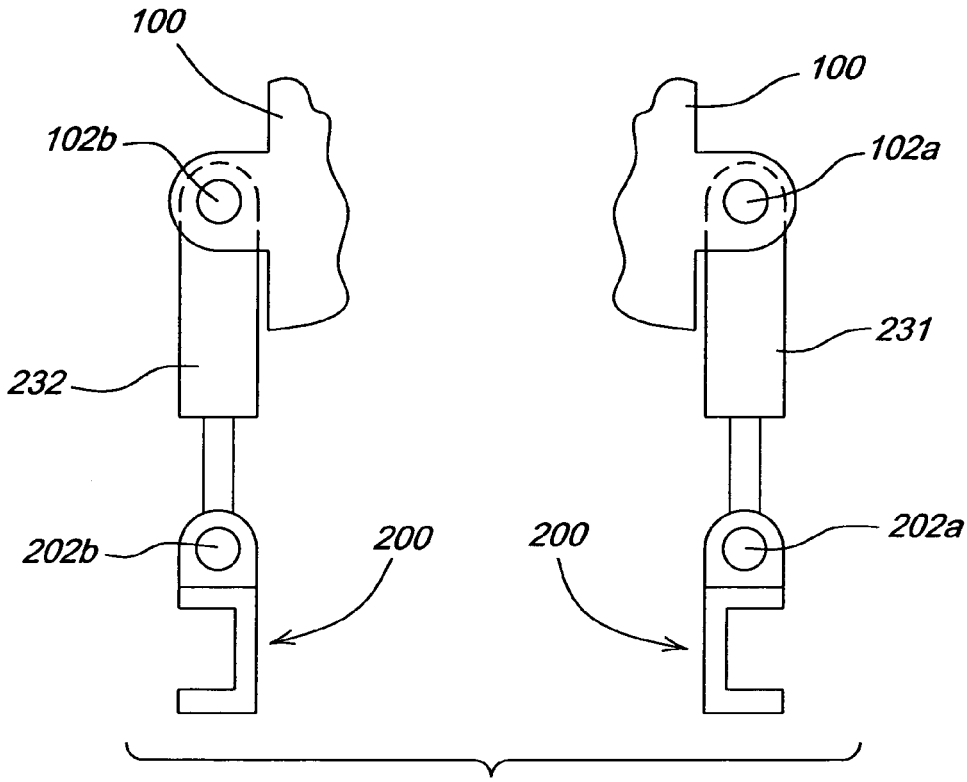
FIG. 6 is a front view of the front portion of the chassis and the first A-frame connected by two suspension cylinders.
Figure 8:
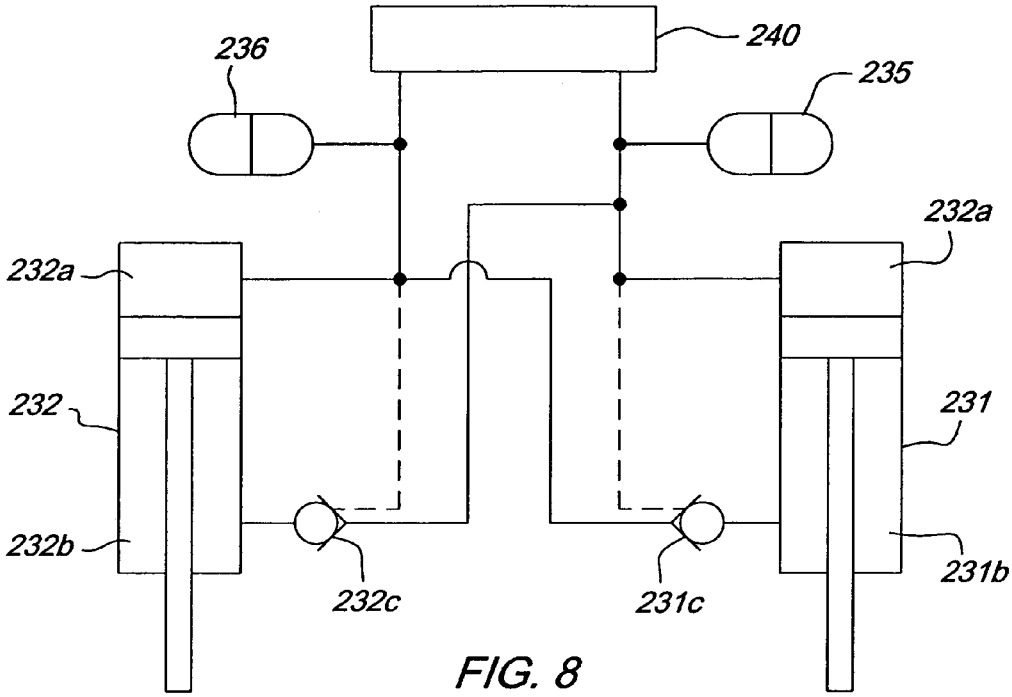
FIG. 8 is an exemplary schematic of the cylinders illustrated in FIG. 5.

A first A-frame 200 is pivotally connected to both the first and second track frames or rocker arms 51 and 61 at mounting frames 20*a* and 200*b* which are integral portions of the first A-frame 200 as illustrated in FIG. 2. The first A-frame 200 is connected to the front chassis portion 100, primarily at the top of the "A", i.e., near the narrowest portion of the first A-frame 200 along the vehicle length, via a first spherical ball joint 201 as illustrated in FIGS. 2 and 3. The first spherical ball joint 201 is proximal to but forward of the articulation joint 40. Laterally, the first A-frame 200 is connected to the front chassis portion 100 with a first linkage (first pan-hard rod) 300 (see FIG. 4) to keep the position of the first A-frame 200 approximately centered under the front chassis portion 100. As illustrated, the first pan-hard rod 300 is pivotally connected to both the front chassis portion 100 and the first A-frame 200. The front chassis portion 100 is vertically connected to the first A-frame 200 by a first suspension cylinder 231 and a second suspension cylinder 232 as shown in FIG. 6. As illustrated, each suspension cylinder 231, 232 is pivotally connected to both the first A-frame 200 and the front chassis portion 100. Further, each of the suspension cylinders 231, 232 is attached to a first balancing circuit 240 and one of corresponding first and second hydraulic accumulators 235, 236 as shown in FIG. 8. Height sensing mechanisms 260 on both sides of the front chasis portion 200 sense the position of the first A-frame 200 relative to the front chassis portion 100 at each cylinder location. The vehicle height sensor 260 for only one side of the vehicle 10 is illustrated as the vehicle height sensors 260 for both sides are identical. Vehicle height is controlled by controlling the flow of hydraulic fluid to and from each of the first and second suspension cylinders 231, 232 via the first balancing circuit 240. These suspension cylinders 231, 232 primarily support the vehicle weight.

It is also desired to control vehicle roll position at this front axle 203. To accomplish this, the head end of the first cylinder 231 is hydraulically connected to the rod end of the second cylinder 232. Conversely the head end of the second cylinder 232 is hydraulically connected to the rod end of the first cylinder 231 as illustrated in FIG. 8. This arrangement reduces the effective working pressure area for the cylinder, making it equivalent to the rod area of the cylinder. This results in a higher pressure in the system which is desirous for improved suspension control.

The first and second cylinders 231, 232 are attached to the first A-frame 200 at a point behind the respective first and second track frame pivots 51*a*, 61*a* necessitating increased operating pressure levels. The higher pressure levels contribute to the roll stability mentioned above.

Figure 5:
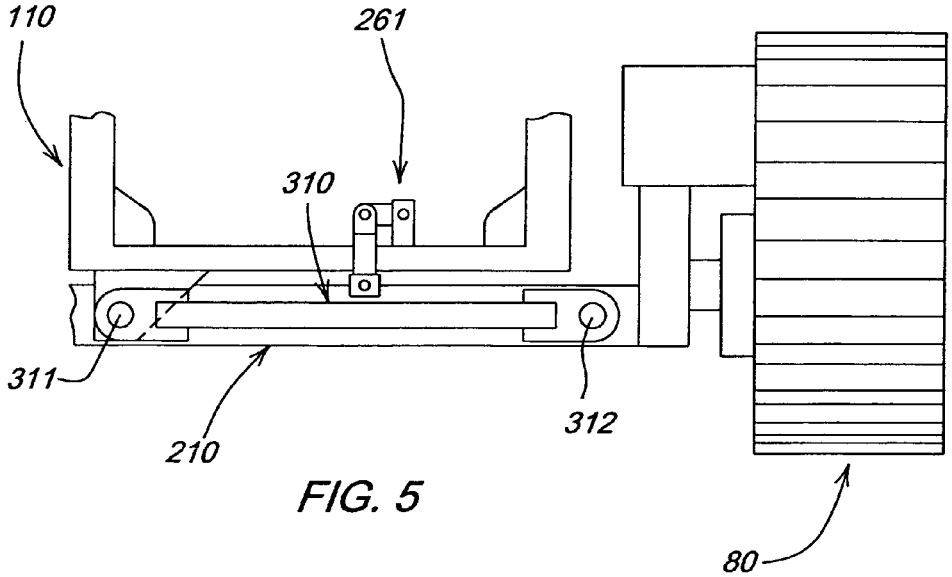
FIG. 5 is a rear view of a rear portion of the chassis and a second A-frame connected by a pan hard rod.
Figure 7:
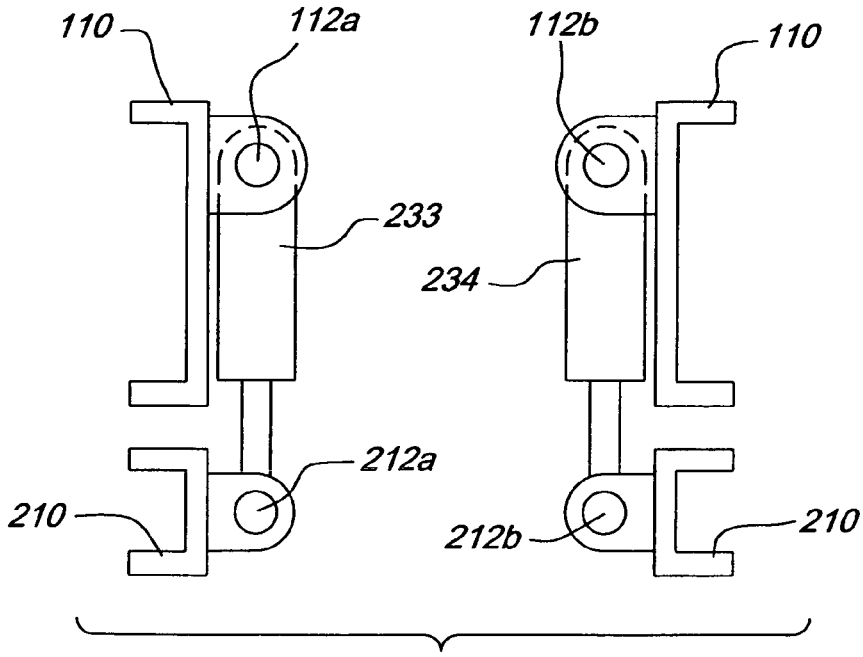
FIG. 7 is a rear view of a rear portion of the chassis and a second A-frame connected by two suspension cylinders.
Figure 9:
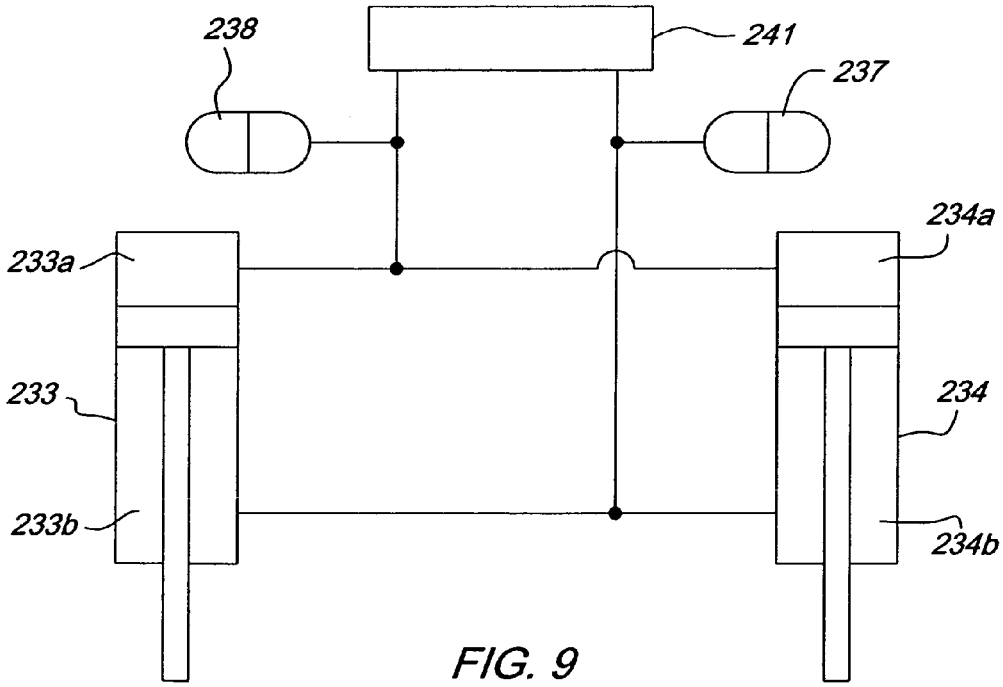
FIG. 9 is an exemplary schematic of the cylinders illustrated in FIG. 6.

A second A-frame structure 210 is pivotally connected to both the third and fourth track frames, i.e., rocker arms 71,81. The second A-frame 210 is connected to the rear chassis portion 210, i.e., the narrowest portion of the second A-frame 210 along the vehicle length, primarily at the top of the "A" with a spherical ball joint 211 as illustrated in FIGS. 2 and 3. This point is located to the rear of the articulation joint 40. Laterally the second A-frame 210 is connected to the rear chassis portion 110 with a linkage (second pan-hard rod) 310 to the second A-frame 210 to keep the second A-frame approximately centered under the rear chassis portion 110 (see FIG. 5). The rear chassis portion 110 is vertically connected to the second A-frame 210 by third and fourth hydraulic cylinders 233,234, one on the left and one the right side of the vehicle as shown in FIG. 7. Each of the third and fourth cylinders 233, 234 is pivotally connected to both the rear chassis portion 110 and the second A-frame 210 to allow angular changes in the relative positions of the rear chassis portion 110 and the second A-frame 210. These cylinders 233,234 are hydraulically connected together and each is connected to a second balancing circuit 241 and one of corresponding third and fourth hydraulic accumulators 237, 238 as illustrated in FIG. 9. A height sensing mechanism 261 (see FIG. 5) senses the position of the second A-frame 210 relative to the rear chassis portion 210 at a point approximately midway between the cylinders indicating the average location. The vehicle height with respect to the rear vehicle portion 30 is controlled by controlling the flow of hydraulic fluid to and from the third and fourth hydraulic cylinders 233, 234 on a continuous basis, via the second hydraulic balancing circuit 241, based on the distances sensed by the height sensing mechanism 261.

It is desired to have the rear axle oscillate to ensure all 4 tracks maintain ground contact at all times. This is done by hydraulically connecting the head ends of the third and fourth cylinders 233, 234 together to allow oil to flow from one to the other as needed. The rod ends of the third and fourth cylinders 233, 234 are also hydraulically connected.

The third and fourth suspension cylinders 233, 234 are attached to the second A-frame 210 at a point behind the third and fourth rocker arm pivots 71*a*, 81*a* so that they operate at reduced pressure levels and provide for a smoother and softer ride.

First and second balancing circuits 240, 241 are hydraulic circuits that maintain the nominal distances between the front chassis portion 100 and the first A-frame 200 and the rear chassis portion 110 and the second A-frame 210.

The blade mounting structure, referred to as the C-Frame 23, is operatively attached to the first A-Frame 200. This ensures that the blade level (right to left with respect to the operator) will be consistent with the positions of the track systems 50, 60 and that it will not be unduly affected by motions of the front chassis portion 100 which are enabled by the suspension system motion.

Figure 10:
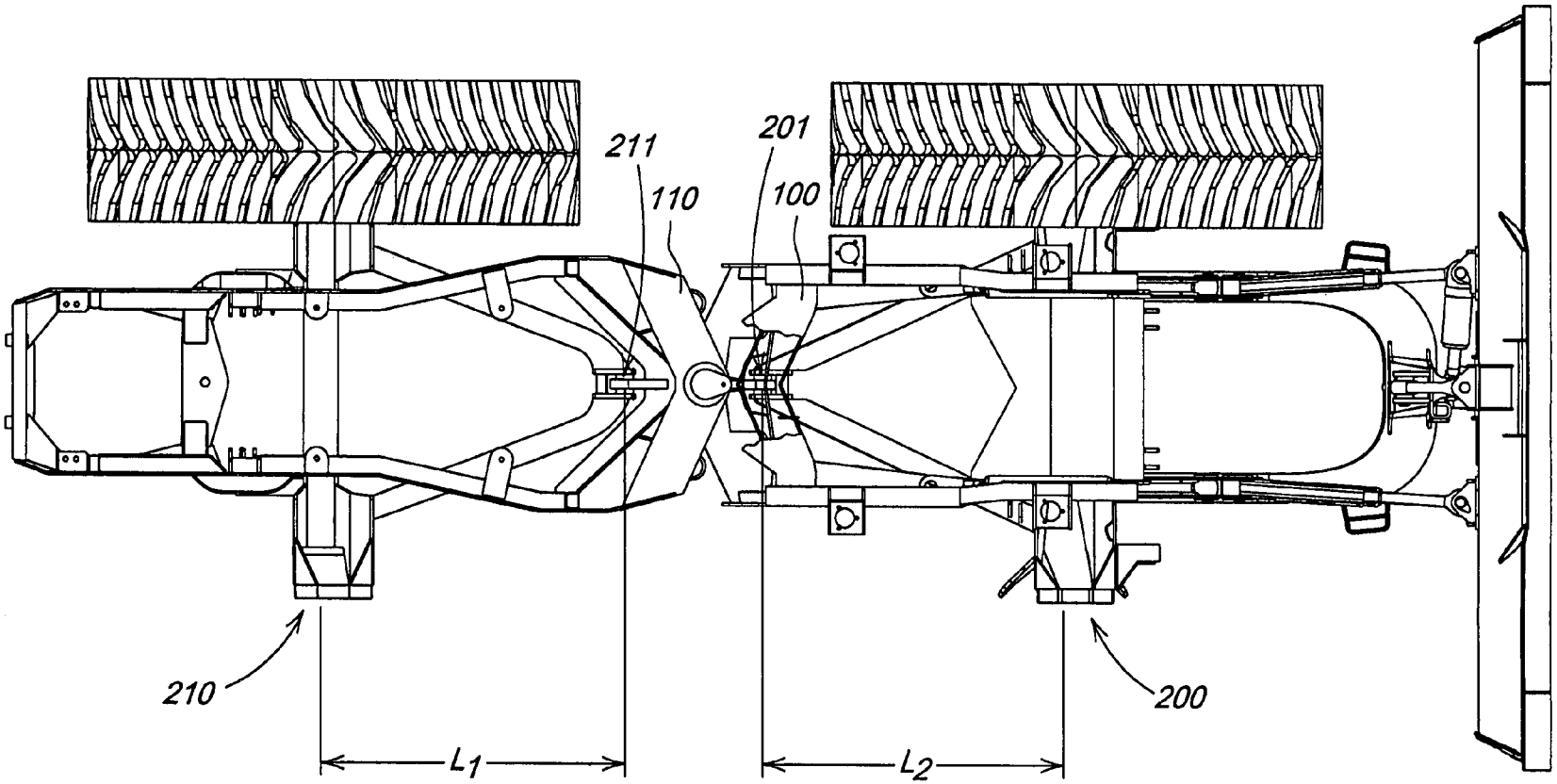
FIG. 10 is a plan view of the vehicle chassis and A-frames illustrated in FIG. 2, showing the relative lengths of the A-frames.

As illustrated in FIG. 10, the first A-frame 200 and the second A-frame 210 are of approximate equal lengths along the centerline of the articulated dozer 10. Further the respective first and second ball joints 201, 211 are positioned as closely as practical to the articulation joint 40. During grading operations of the vehicle 10, tractive efforts tend to vary and to, thereby, generate vertical loads at the ball joints. As a result of this arrangement, the vertical forces generated at the ball joint attachments to the chassis for each of the first and second A-frames 200 and 210, due to variations in tractive efforts, tend to be equal in magnitude and opposite in direction. Thus, due to the structure of the suspension system, the forces at the ball joints tend to cancel each other and to result in minimal torque on the vehicle chassis, i.e., the front and rear chassis portions 100 and 110. Height variations due to variations in tractive efforts are significantly smaller in comparison to alternative suspension systems.

Having described the illustrated embodiment, it will become apparent that various modifications can be made without departing from the scope of the invention as defined in the accompanying claims.

The invention claimed is:

1. An articulated dozer, comprising:

a front chassis portion;

a rear chassis portion connected to the front chassis portion via an articulation joint;

a first A-frame;

a second A-frame, the front chassis portion and the rear chassis portion, respectively suspended above the first and second A-frames;

a first suspension system supporting a first portion of a weight of the articulated dozer above the first A-frame;

a second suspension system supporting a remainder of the vehicle weight above the second A-frame;

a first pivot; and a second pivot, a narrow portion of the first A-frame connected to the front chassis portion via the first pivot, a narrow portion of the second A-frame connected to the rear chassis portion via the second pivot, the first pivot and the second pivot in proximity to the articulation joint.

2. The articulated dozer of claim 1, wherein a length of the second A-frame is approximately equal to a length of the first A-frame.

3. The articulated dozer of claim 1, wherein the first pivot is a ball joint.

4. The articulated dozer of claim 1, wherein the second pivot is a ball joint.

5. The articulated dozer of claim 1, further comprising:

first and second track assemblies pivotally connected to the first and second sides of a wide portion of the first A-frame, respectively; and third and fourth track assemblies pivotally connected to the first and second sides of a wide potion of the second A-frame.

* * * * *